United States Patent [19]

Saccoccio

[11] 4,185,471

[45] Jan. 29, 1980

[54] EAR CLIP HAVING PIVOTED ARMS HELD BY FRICTION

[75] Inventor: Nazareno J. Saccoccio, East Greenwich, R.I.

[73] Assignee: Aro-Sac Inc., Providence, R.I.

[21] Appl. No.: 946,209

[22] Filed: Sep. 25, 1978

[51] Int. Cl.[2] ..... A44C 7/00

[52] U.S. Cl. ..... 63/14 C; 24/248 R

[58] Field of Search ..... 63/14 C, 14 R, 14 D, 63/14 F; 24/252, 248 R

[56] References Cited

U.S. PATENT DOCUMENTS

| | | | |
|---|---|---|---|
| 2,773,293 | 12/1956 | Watson | 24/252 |
| 2,947,054 | 8/1960 | Adams | 24/248 |
| 3,176,475 | 4/1965 | Saccoccio | 63/14 D |
| 3,462,808 | 8/1969 | Saccoccio et al. | 24/248 |
| 3,568,271 | 3/1971 | Saccoccio et al. | 24/248 |
| 3,990,266 | 11/1976 | Saccoccio | 63/14 D |

*Primary Examiner*—F. Barry Shay
*Attorney, Agent, or Firm*—Salter & Michaelson

[57] ABSTRACT

The present invention is directed to an ear clip for earrings and the like in which a pair of pivotally connected members move relative to each other against the action of a pronounced frictional drag provided by a spring member. The spring member is a reversely bent generally U-shaped leaf spring having opposed free ends. A looped end portion of the other member generally encircles said free ends and maintains them under tension such that the force attempting to move the free ends apart provides the aforementioned frictional drag upon the looped end of the other member. The looped end is generally circular in configuration although it may include one or more lobes such that the members will snap into open or closed position. Also, adjustment means may be provided to increase or decrease the spring tension exerted, and thus vary the frictional drag upon the members as they move relative to each other.

10 Claims, 9 Drawing Figures

EAR CLIP HAVING PIVOTED ARMS HELD BY FRICTION

BACKGROUND AND SUMMARY OF THE INVENTION

Ear clips normally take the form of separate pivotally attached members which are movable relative to each other between open and closed positions such that the members serve to clamp outer surface areas of a wearer's earlobe disposed therebetween and accordingly enable the ear clip to be mounted thereon. Normally, the ear clip includes ornamentation and thus forms an earring. Generally, such constructions include a stationary jaw or body portion to which a separate leaf spring is attached by means of upwardly bent tabs and the like and which serves to engage terminal portions of the movable jaw or clip arm near its attachment to the body so as to resiliently urge the clip arm to a fully opened and/or a fully closed position. As an example of such an ear clip construction, note U.S. Pat. No. 3,176,475 issued Apr. 6, 1965.

As the incorporation of a separate spring necessitates an additional and accordingly generally costly added assembly operation, it has been found desirable in some cases to eliminate the separate spring member by integrally incorporating such into the structure of one of the pivotally connected members (generally that designated the stationary jaw or body portion). An example of such an earring construction is shown in applicant's previous U.S. Pat. No. 3,990,226 issued Nov. 9, 1976. It has now been found desirable in earring constructions of this type to incorporate means by which a significant or pronounced frictional drag may be imparted to the members as they are pivotally moved relative to one another such that they may be maintained in any number of partially opened positions relative to each other rather than be resiliently urged to fully open or fully closed positions.

It is accordingly a primary object of the present invention to provide an ear clip of the type under consideration in which the pivotally movable members thereof undergo a pronounced frictional drag as they move relative to each other such that they may be positioned in a variety of attitudes with respect to each other whereby the degree of clamping force may be readily adjusted to achieve both a secure grip and maximum comfort to the wearer.

A still further object of the present invention is the provision of a clip structure of the above-indicated type in which the frictional drag above-referred to is imparted by a spring member integrally formed from one of the pivotally movable members.

A still further object of the present invention is the provision of a clip structure as set forth in the immediately aforementioned object in which the tension of the spring member may be varied so as to impart a greater or lesser degree of frictional drag between the members as they are pivotally moved with respect to each other.

These and other objects of the present invention are accomplished by the provision of a pair of pivotally connected members wherein one of the members is a reversely bent leaf spring having opposed arms each terminating in free ends. The arms include openings passing therethrough such that a loop portion disposed at one end of the other member may pass through such openings and encircle the free ends of the spring member so that they are under tension and accordingly impart a frictional drag on the members as they move relative to each other. Additionally, means are provided to adjust the tension of the free ends both in situ by various means for spreading apart the opposed spring arms and upon relative rotation of the loop portion by the provision of one or more interior lobes thereon.

Reference is also made to the following previous patents of the present applicant, U.S. Pat. No. 3,462,808 issued Aug. 26, 1969 and 3,568,271 issued Mar. 9, 1971. Such patents although not pertinent in regard to the major objects of the present invention do show lobed loop configurations. The above prior art citations and their discussion constitutes applicant's Prior Art Disclosure and in such regard, a copy of each such patent referred to above is enclosed with this application.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
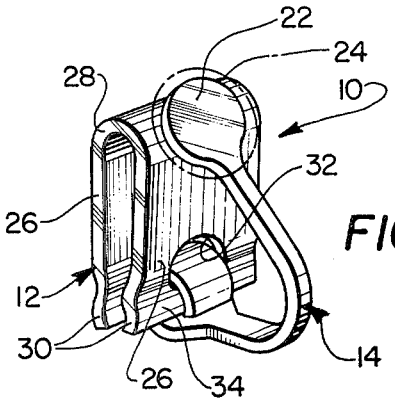
FIG. 1 is a perspective view of an earring clip embodying the present invention.
Figure 2:
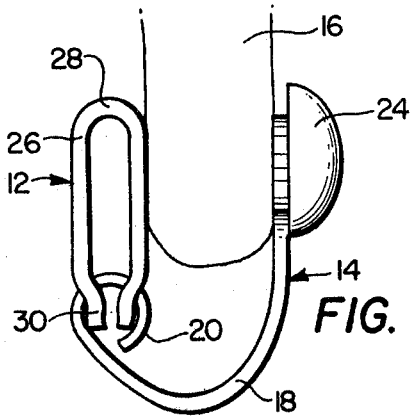
FIG. 2 is a side elevational view thereof.
Figure 3:
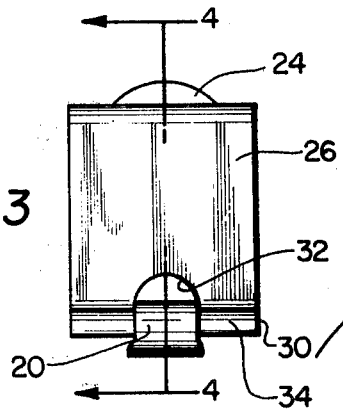
FIG. 3 is an end view of the clip taken from the left side of FIG. 2.
Figure 4:
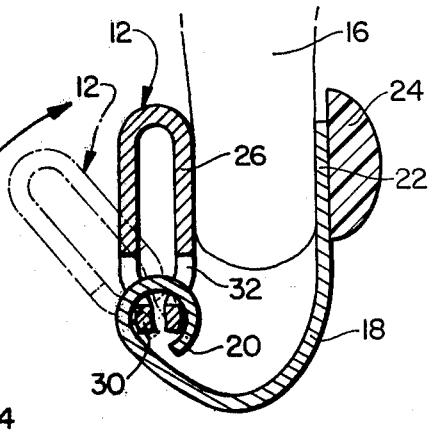
FIG. 4 is a side sectional view taken along the line 4—4 of FIG. 3 and shows in phantom one manner in which the members of the ear clip may be moved relative to each other.

Turning to the drawing and particularly FIGS. 1 through 4 thereof, an earring 10 is shown. Such includes a first member 12 and a second member 14 pivotally attached to each other and movable between various relatively open and closed positions so as to enable the earring to be satisfactorily clamped to the earlobe 16 of the wearer. The second member 14 includes a body 16 of generally elongated somewhat J-shaped configuration and provided with a looped portion 20 at one end thereof and a flattened head 22 at the other end thereof. The flattened head 22 is furthermore primarily provided with an ornament 24 secured thereto by any suitable means such as adhesive connection and the like. The inner surface of the flattened portion 22 is adapted to contact the outer surfaces of the wearer's earlobe 16 and accordingly the second member 14 may be conventionally designated as a clip arm.

The first or body member 12 comprises a generally flat reversely bent leaf spring including opposed arm portions 26 and a connecting base 28. The arm portions terminate in free ends 30. The overall configuration of the spring member 12 is accordingly generally U-shaped.

The opposed arms 26 are each provided with an opening 32 therethrough. The openings 32 are disposed proximate the free ends 30 and generally centrally of the arms 26. The openings 32 are aligned with each other and are adapted to receive the loop portion 20 therethrough such that the loop at least partially encircles the free ends and is in contact therewith. Generally, the cross-sectional configuration of the loop portion 20 is circular and the outer surfaces 34 of the free end 30 may be similarly configured so as to conform to the interior surface of the loop 20. Furthermore, the extent of the loop 20 is such that free ends 30 disposed therein are placed under tension, that is, the opposed arms 26 are forced towards each other about the base 28 and accordingly impart a constant outward tension upon the inner surfaces of the loop 20 such that, as the members 12 and 14 are pivotally moved relative one another, a significant frictional drag is imparted thereto and accordingly the earring 10 may be maintained in any desired position as particularly illustrated. in FIG. 4. Such positions include not only a fully opened and a fully closed position, but various intermediate positions such that various clamping pressure may be applied to the earlobe 16 dependent on the wearer's wishes and appropriate spacing adjustments made for different sized earlobes.

Figure 5:
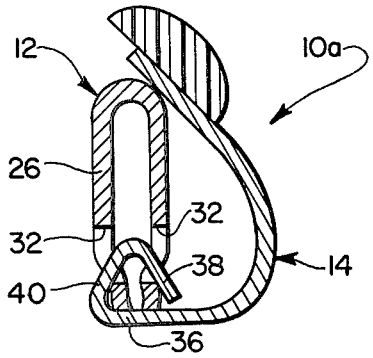
FIG. 5 is a side sectional view similar to FIG. 4 but showing a modified constructional embodiment of the invention.
Figure 6:
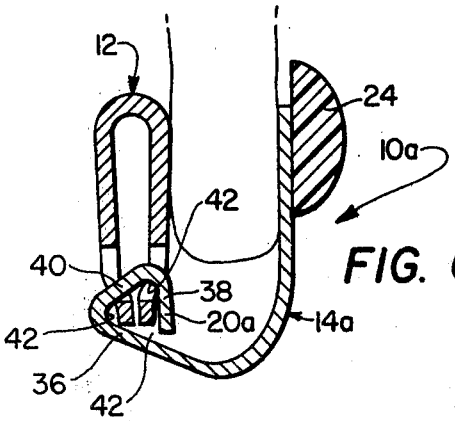
FIG. 6 is a side sectional view showing the embodiment of FIG. 5 positioned on the earlobe of the wearer.

Turning now to FIGS. 5 and 6 of the drawing, a modification of the present invention is shown in which an earring **10*a* of similar configuration to that shown in FIGS. 1 through 4 is provided with a loop portion 20*a* of modified construction so as to enable the earring to be moved more positively between predetermined fully open or fully closed positions. Accordingly, the loop 20*a* is of generally triangular cross-sectional configuration and includes opposed running and terminal legs 36 and 38, respectively. Legs 36 and 38 are connected to each other by a base leg 40 so as to define a plurality of lobes 42. In this manner then, the free ends 30 are frictionally urged to move into positions defined by pairs of adjacent lobes 42 such as the fully closed position shown in FIG. 5 and the operative position shown in FIG. 6** wherein the earlobe is resiliently clamped.

Figure 7:
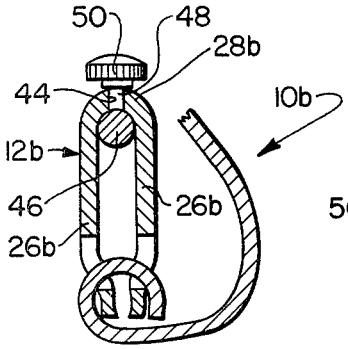
FIG. 7 is a side sectional view of still a further constructional embodiment of the present invention wherein means are provided for increasing the tension of the spring member.
Figure 8:
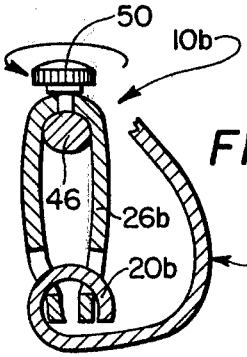
FIG. 8 is a side sectional view similar to FIG. 7 showing the tension increasing means having been moved to an alternate position.

A further modification of the device is shown in FIGS. 7 and 8 wherein an earring **10*b* includes structure which may be similar to that shown in either FIGS. 1 through 4 or FIGS. 5 and 6 of the drawing, but further includes a modified spring member construction 12*b*. Therein the base 28*b* thereof is provided with a bore 44 and an eccentric element 46 is disposed adjacent thereto and in mutual contact with the opposed arms 26*b*. The eccentric member includes a shaft 48 in turn connected to a knurled nut 50 such that the eccentric element may be moved between a normal position as shown in FIG. 7 to a modified position as shown in FIG. 8 wherein the legs 26*b* are forced apart such that a greater tension and accordingly an increased frictional drag is brought to bear upon the loop 20*b*. The element 46 is generally of elliptical or ovate configuration so as to define a smaller minor axis and a greater major axis such that the lateral extent of the element 46 as disposed between the opposed arms 26 is greater when positioned along the major axis as shown in FIG. 8** of the drawing.

Figure 9:
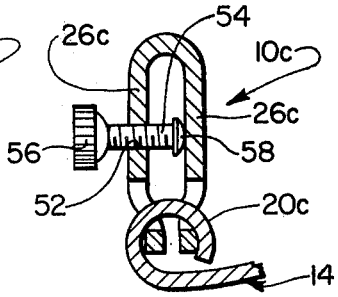
FIG. 9 is a side sectional view showing another constructional embodiment of the invention in which alternate means are provided for varying the tension upon the spring member.

A still further modification of the present invention is depicted in FIG. 9 wherein an earring **10*c* also includes means as in the case of the FIGS. 7 and 8 embodiment for the in situ adjustment of the spring tension upon the free ends. In this form the outer arm 26*c* is provided with a threaded bore 52 in which a threaded rob 54 is disposed. One end of the rod 54 includes a knurled nut 56 and the other end terminates in a headed member 58 adapted to engage the inner surface of the opposing arm 26*c*. Accordingly, by turning the knurled nut 56 in either direction, the space between the opposed arm 26*c* may be varied and accordingly, the tension upon the loop 28*c*** likewise varied.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clip for earrings and the like comprising a pair of pivotally connected members each having a portion adapted to engage respective opposite sides of a wearer's earlobe and movable to various positions wherein said members effect a clamping grip on said earlobe, one of said members being a spring member having arms terminating in opposed free ends, said arms including openings which are aligned to form a passage through said arms and disposed proximate said free ends thereof, the other of said members terminating in a loop portion at one end thereof, said loop portion passing through said openings and at least partially encircling said free ends and in contact therewith so as to place said free ends under tension and accordingly impart a frictional drag on said members during at least a portion of the respective pivotal movement thereof between said various positions.

2. The clip structure of claim 1, wherein said free ends are under constant tension such that frictional drag is imparted to said members in all relative positions thereof.

3. The clip structure of claim 1, said spring member is a leaf spring of generally U-shaped cross-sectional configuration wherein said arms are interconnected at a base thereof, said arms defining at least one relatively flat surface adapted for contact by inner surface portions of said earlobe, said other member being a clip arm terminating at the other end thereof in a relatively flat surface adapted for contact by an outer surface portion of said earlobe.

4. The clip structure of claim 2, said loop portion being generally of circular cross-sectional configuration, the outer surfaces of said free ends being of an arcuate configuration conforming to the inside loop surface.

5. The clip structure of claim 3, including means for in situ adjusting the spring tension exerted by said spring member on said free ends thereof.

6. The clip structure of claim 1, said loop including at least one lobe such that the compression and accordingly the frictional drag between said members varies as the free ends move relative to said loop.

7. The clip structure of claim 6, said loop being substantially triangular in cross-sectional configuration.

8. The clip structure of claim 5, said adjusting means including a post threadably engaged within a bore provided through one of said opposed spring arms, one end of said post adapted to engage the inner surface of said other spring arm such that relative movement of said post with respect to said one arm forces said arms apart so as to increase the tension between said free ends.

9. The clip structure of claim 5, said adjusting means including an eccentric element disposed between and in contact with said spring arms, and meams for turning said element so as to respectively increase and decrease the spacing of said arms.

10. The clip structure of claim 9, said element disposed proximate said spring member base portion and said turning means including a shaft connected to said element and passing through a bore provided in said base portion.

* * * * *